US006398611B1

(12) United States Patent
Lin

(10) Patent No.: US 6,398,611 B1
(45) Date of Patent: Jun. 4, 2002

(54) FIGURED BUBBLE-BLOWING TOY

(76) Inventor: Mo-Hsin Lin, 5th Floor, No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 09/799,570

(22) Filed: Mar. 7, 2001

(51) Int. Cl.[7] ..... A63H 33/28; A44B 21/00
(52) U.S. Cl. ..... 446/15; 24/3.13
(58) Field of Search ..... 446/15, 16, 17, 446/18, 19, 20, 21, 61, 68; 40/408; 24/3.13, 5, 710.5

(56) References Cited

U.S. PATENT DOCUMENTS 3,787,998 A * 1/1974 Kilroy et al. ..... 446/61
5,393,256 A * 2/1995 Mitchell et al. ..... 446/15
5,695,379 A * 12/1997 Ho ..... 446/15
5,860,173 A * 1/1999 Herring ..... 239/316
5,928,049 A * 7/1999 Hudson ..... 446/15
6,093,075 A * 7/2000 Lin ..... 446/16

* cited by examiner

*Primary Examiner*—Jacob K. Ackun
*Assistant Examiner*—Faye Francis
(74) *Attorney, Agent, or Firm*—Troxell Law Office PLLC

(57) ABSTRACT

A figured bubble-blowing toy includes a wing device shaped like the wings of a flying animal, the wing device having a center through hole, a solution body shaped like a flying animal, the solution body having a T-shaped retaining block extended from a top sidewall thereof and inserted through the center through hole of the wing device, and a fastener fastened to the T-shaped retaining block to secure the wing device to the solution container.

1 Claim, 7 Drawing Sheets

FIGURED BUBBLE-BLOWING TOY

BACKGROUND OF THE INVENTION

The present invention relates to bubble-blowing toys and, more particularly, to a figured bubble-blowing toy, which comprises a solution container shaped like the body of a flying insect, a wing device shaped like the wings of a flying insect, and a fastener fastened to the solution container to fixedly secure the wing device to the solution container.

Bubble-blowing toys are cheap toys that are thrown away after their use. A conventional bubble-blowing toy uses a plastic container to hold a solution for blowing bubbles, and a bubble-blowing coil with a handle for dipping in the solution to pick up a small amount of the solution for blowing bubbles. In order to attract children, figured solution containers for bubble-blowing toys are developed. These figured solution containers are shaped like a flying insect. According to these figured solution containers, the wing device is fastened to the body of the solution container by an adhesive. Because the wing device is adhered to the solution container, it tends to be pulled apart from the solution container.

SUMMARY OF THE INVENTION

The present invention has been accomplished to provide a figured bubble-blowing toy, which eliminates the aforesaid problem. According to one aspect of the present invention, the figured bubble-blowing toy includes a wing device shaped like the wings of a flying animal, the wing device having a center through hole, a solution body shaped like a flying animal, the solution body having a T-shaped retaining block extended from a top sidewall thereof and inserted through the center through hole of the wing device, and a fastener fastened to the T-shaped retaining block to secure the wing device to the solution container. According to another aspect of the present invention, the fastener comprises an engagement block, which is locked after connection of the fastener to the T-shaped retaining block, preventing a displacement of the fastener relative to the T-shaped retaining block.

DETAILED DESCRIPTION OF THE PREFERRED EMBODIMENT

Figure 1:
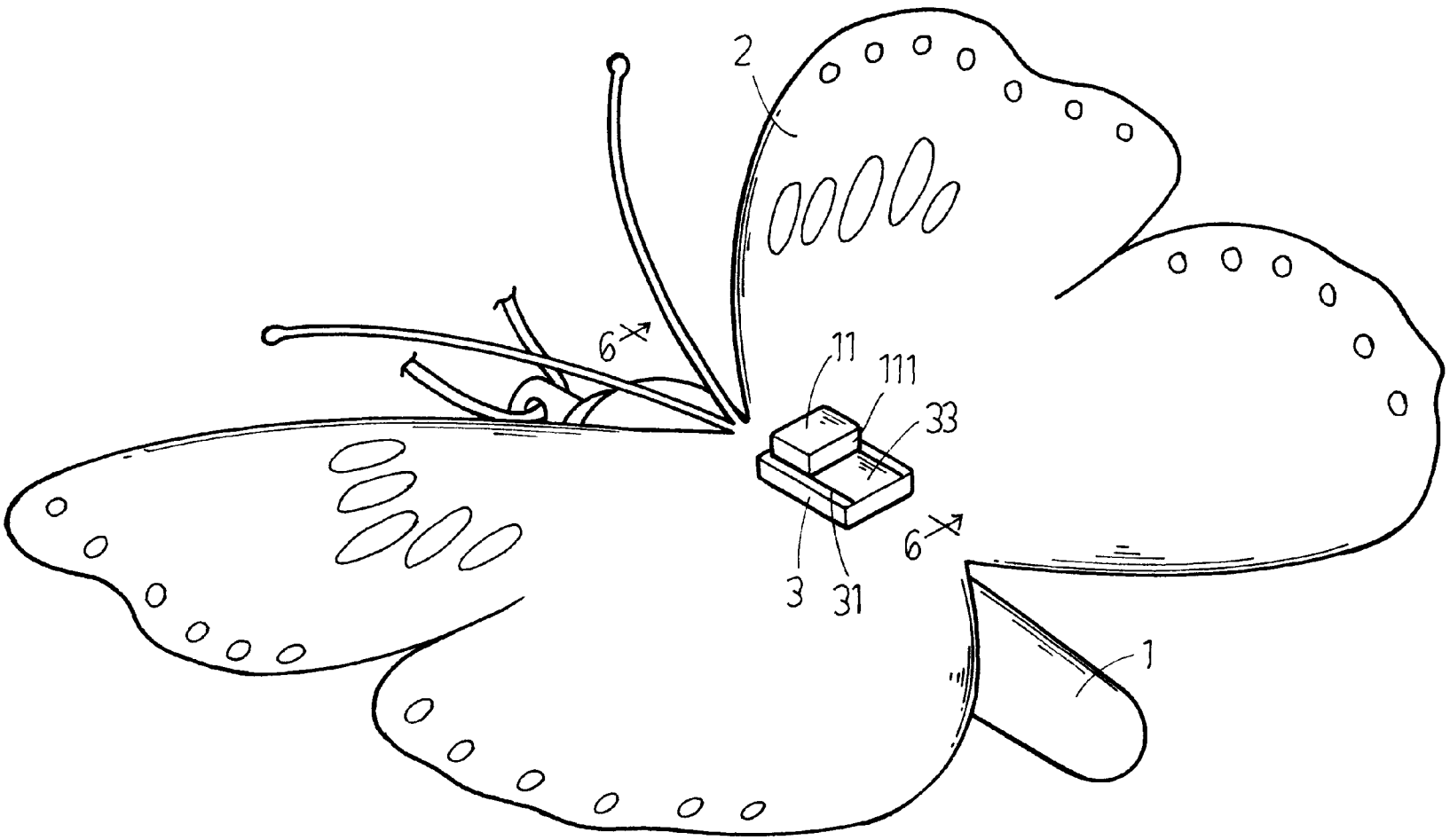
FIG. 1 illustrates a figured bubble-blowing toy constructed according to one embodiment of the present invention.
Figure 2:
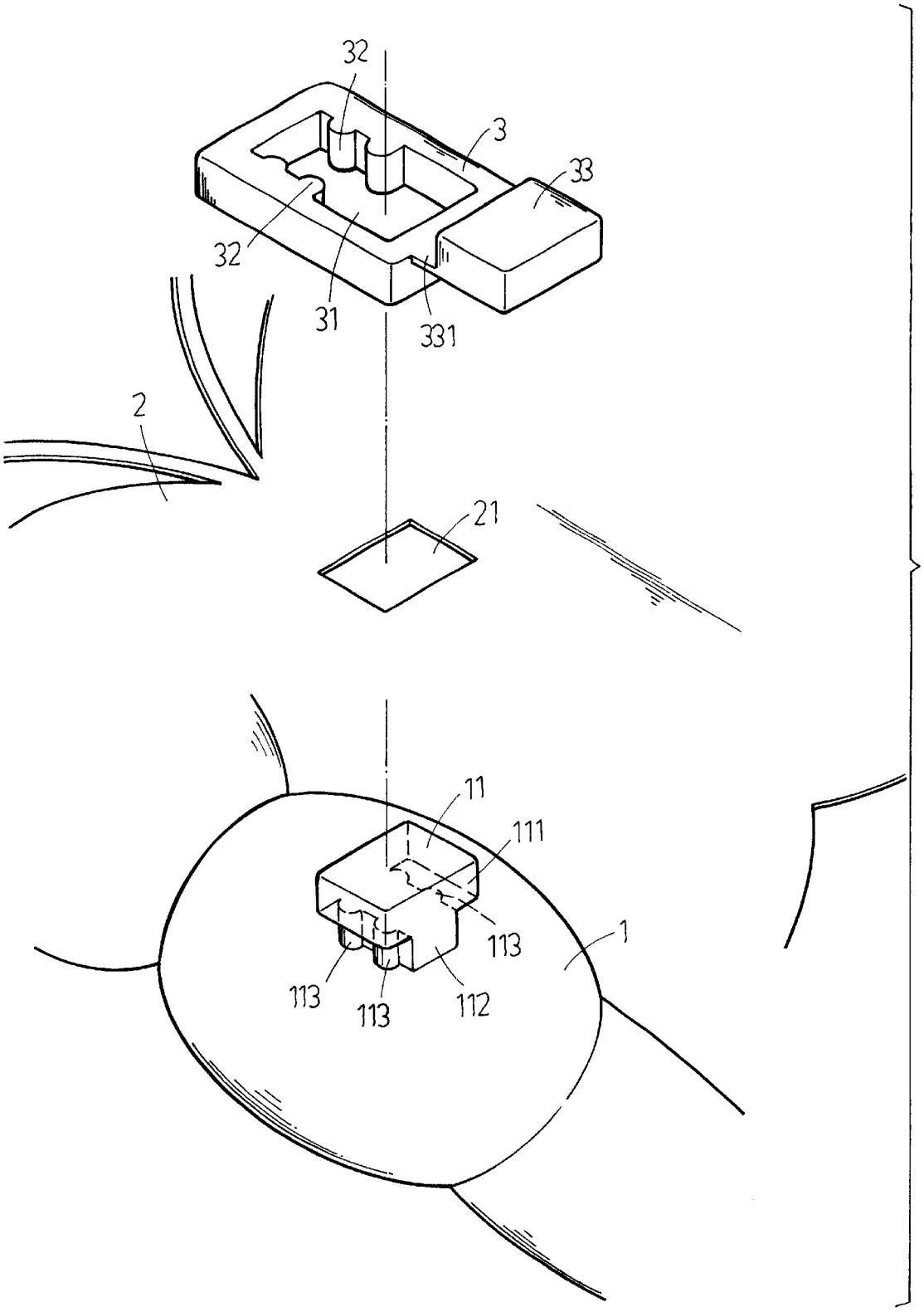
FIG. 2 is an exploded view in an enlarged scale of a part of FIG. 1.
Figure 3:
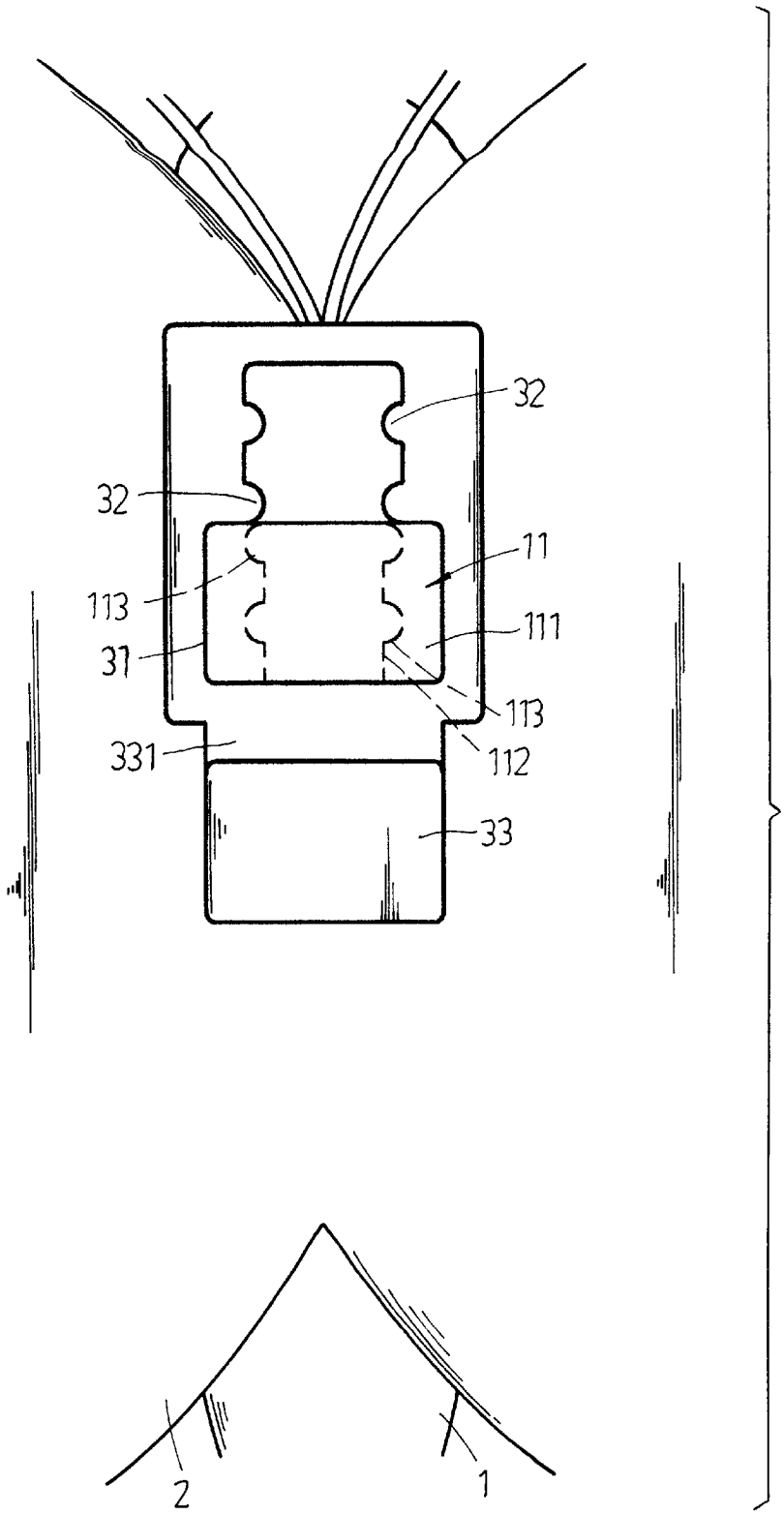
FIG. 3 illustrates the connection of the fastener to the T-shaped retaining block of the solution container according to the present invention (Step I).
Figure 4:
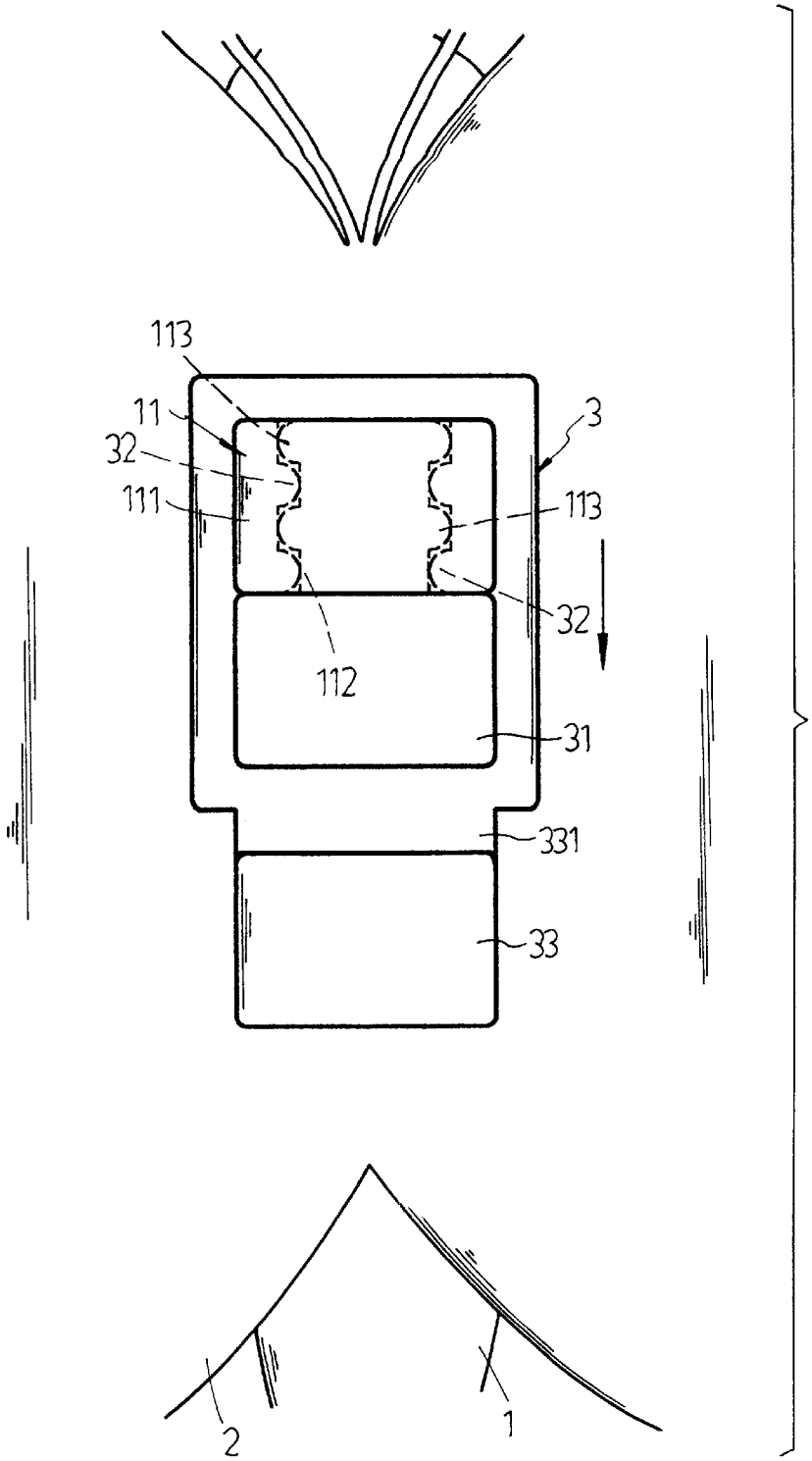
FIG. 4 illustrates the connection of the fastener to the T-shaped retaining block of the solution container according to the present invention (Step II).
Figure 5:
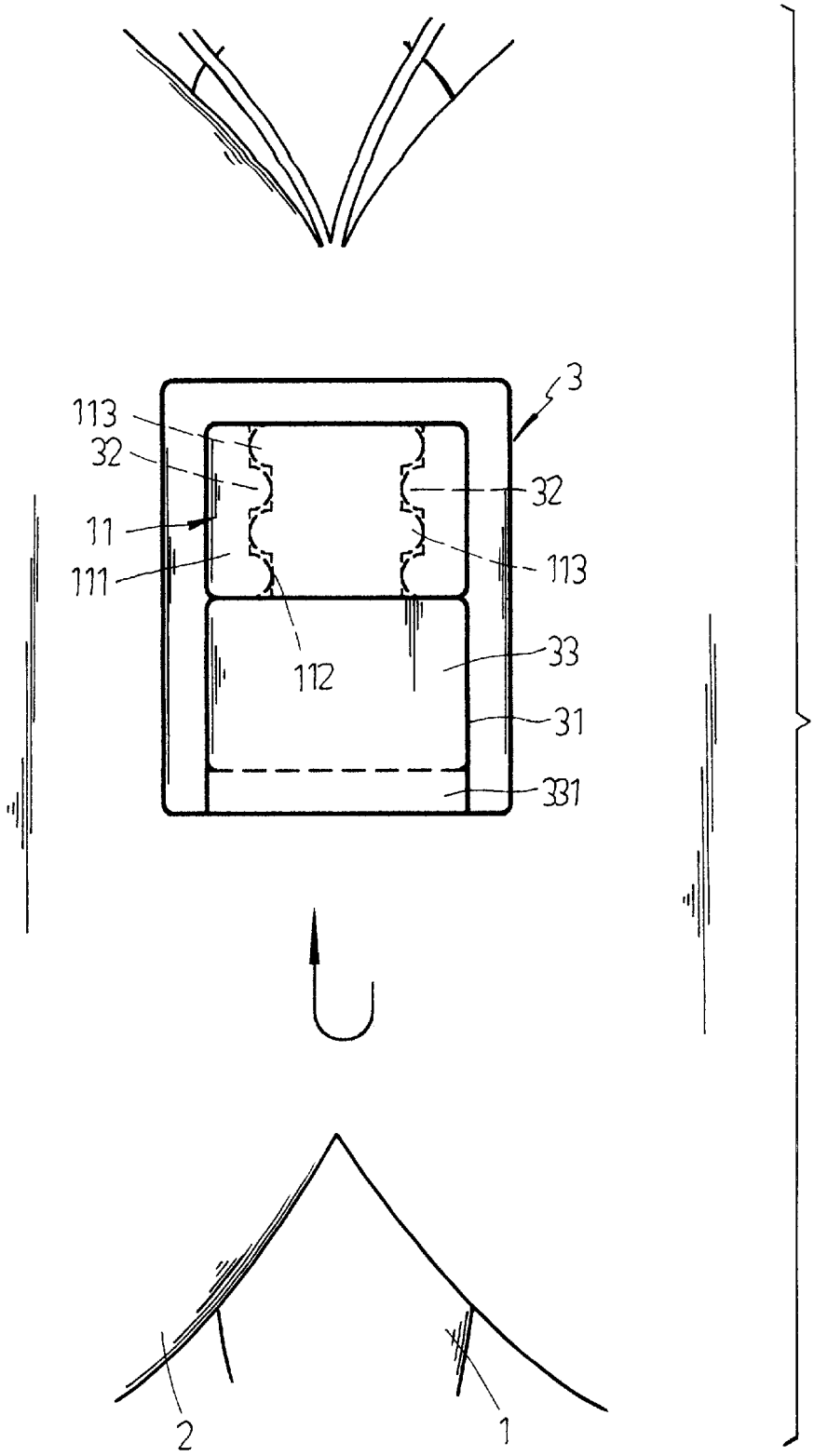
FIG. 5 illustrates the connection of the fastener to the T-shaped retaining block of the solution container according to the present invention (Step III).
Figure 6:
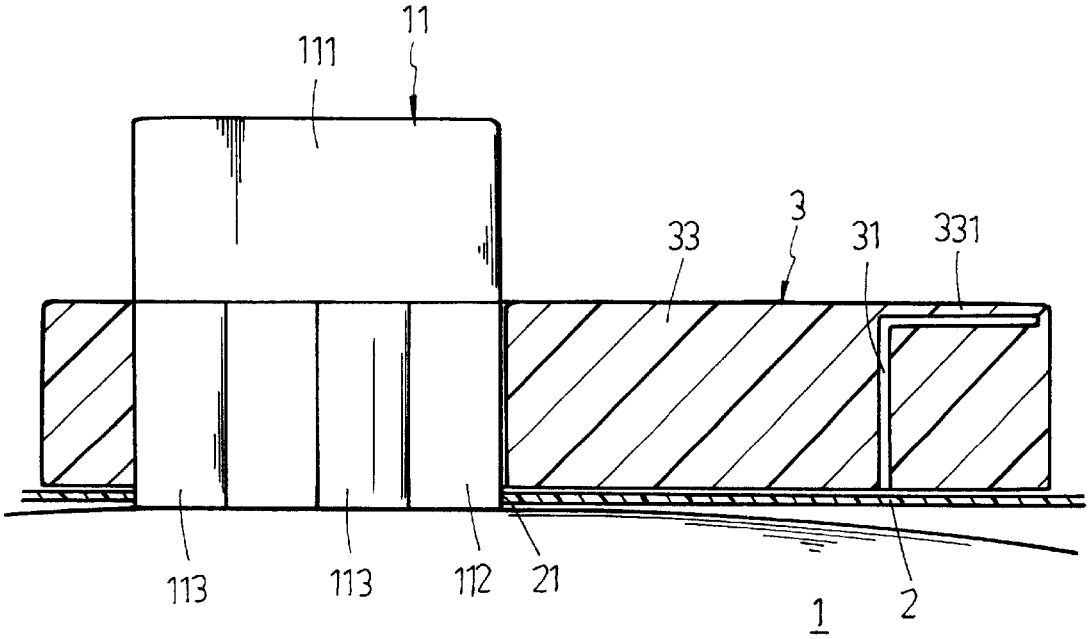
FIG. 6 is a sectional view in an enlarged scale taken along line 6—6 of FIG. 1.
Figure 7:
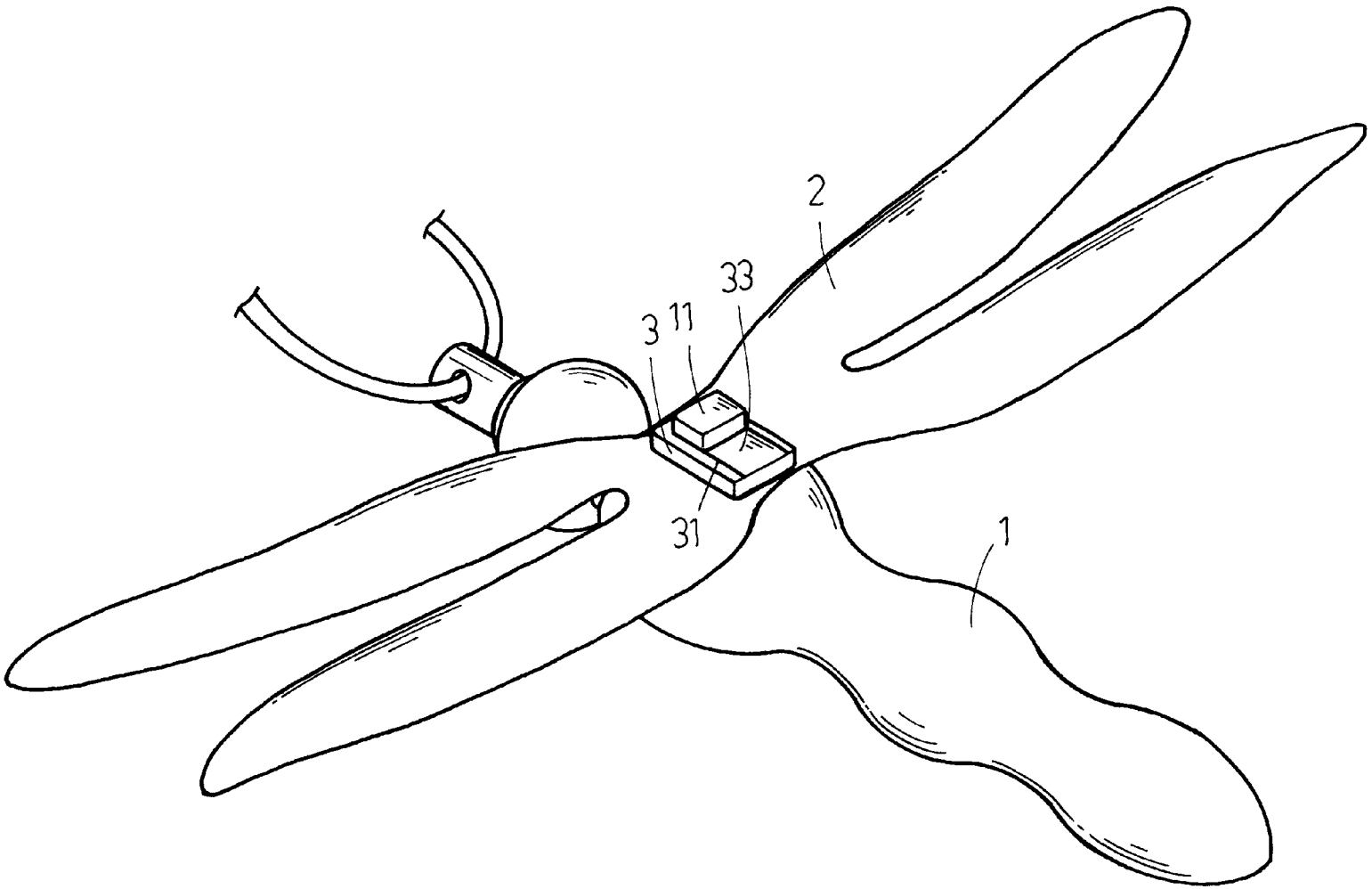
FIG. 7 illustrates a figured bubble-blowing toy constructed according to another embodiment of the present invention.

Referring to FIGS. 1, 2 and 7, a figured bubble-blowing toy in accordance with the present invention is generally comprised of a solution container 1, a wing device 2, and a fastener 3. The solution container 1 is shaped like the body of a flying insect, for example, butterfly, ladybird, bee, and etc. The wing device 2 is shaped like the wings of the flying insect on which the shape of the solution container 1 is based, having a center through hole 21. The solution container 1 comprises a T-shaped retaining block 11 extended from the top sidewall thereof adapted for inserting through the center through hole 21 of the wing device 2. The T-shaped retaining block 11 comprises a flat top head 111, and a bottom shank 112 connected between the flat top head 111 and the top sidewall of the solution container 1. The transverse width between two opposite lateral sidewalls of the bottom shank 112 is smaller than the flat top head 111. The bottom shank 112 has a plurality of protruded portions 113 spaced at two opposite lateral sides. The fastener 3 comprises an insertion hole 3 and a toothed hole 32 vertically extended through the body thereof and disposed in communication with each other, an engagement block 33, and a hinge 331 connected between the body of the fastener 3 and the engagement block 33. The insertion hole 31 is adapted to receive the flat head 111 of the T-shaped retaining block 11 of the solution container 1.

Referring to FIGS. from 2 through 6, after insertion of the T-shaped retaining block 11 through the center through hole 21 of the wing device 2, the fastener 3 is attached to the T-shaped retaining block 11 for enabling the flat head 111 of the T-shaped retaining block 11 to be inserted into the insertion hole 31, and then the fastener 3 and the solution container 1 are pulled in reversed directions to force the protruded portions 113 of the bottom shank 112 of the T-shaped retaining block 11 into engagement with the toothed hole 22 of the fastener 3, keeping the flat head 111 of the T-shaped retaining block 11 supported above the topmost edge of the body of the fastener 3, and then the engagement block 33 is turned inwards toward the body of the fastener 3 and forced into engagement with the insertion hole 31 to stop the fastener 3 from displacement relative to the T-shaped retaining block 11.

A prototype of figured bubble-blowing toy has been constructed with the features of FIGS. 1~7. The figured bubble-blowing toy functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A figured bubble-blowing toy, comprising:

a wing device shaped like a body of a flying animal, said wing device comprising a center through hole;

a solution container shaped like the body of a flying animal, said solution container comprising a T-shaped retaining block extended from a top sidewall thereof and inserted through the center through hole of said wing device, said T-shaped retaining block comprising a flat head and a toothed shank connected between said flat head and the top sidewall of said solution container;

a fastener fastened to said T-shaped retaining block to secure said wing device to said solution container, said fastener comprising a body, an insertion hole vertically extended through said body through which said T-shaped retaining block is inserted, a toothed hole vertically extended through said body and disposed in communication with said insertion hole for engagement with the toothed shank of said T-shaped retaining block after insertion of said T-shaped retaining block through said insertion hole and a relative movement between said fastener and said solution container to let the flat head of said T-shaped retaining block be supported on said body of said T-shaped retaining block above said toothed hole, a hinge extended from one end of said body, and an engagement block connected to said hinge and adapted for engaging into said insertion hole to secure said fastener to said T-shaped retaining block of said solution container.

* * * * *